United States Patent [19]

Yokoyama

[11] Patent Number: 4,671,201

[45] Date of Patent: Jun. 9, 1987

[54] METHOD AND APPARATUS OF AUTOMATICALLY CONTROLLING SAILBOAT

[75] Inventor: Akira Yokoyama, Yokohama, Japan

[73] Assignees: K.K. Yokoyama Zosen Sekkei Jimusho; Nakamura Sengu Kogyo K.K., both of Yokohama; Yoshio Inoue, Miura, all of Japan

[21] Appl. No.: 831,746

[22] Filed: Feb. 20, 1986

[30] Foreign Application Priority Data

Jun. 26, 1985 [JP] Japan ..... 60-139768

[51] Int. Cl.[4] ..... B63H 9/10

[52] U.S. Cl. ..... 114/102; 114/204

[58] Field of Search ..... 114/102–107, 114/204, 205; 73/180, 188, 178 R; 254/272, 273

[56] References Cited

U.S. PATENT DOCUMENTS 2,027,613 1/1936 Pierce, Jr. ..... 114/102 X 3,820,493 6/1974 Amick, Jr. ..... 114/102

3,935,828 2/1976 Pfund ..... 114/102

*Primary Examiner*—Sherman D. Basinger

*Attorney, Agent, or Firm*—Jordan and Hamburg

[57] ABSTRACT

The present invention provides a method of automatically controlling a sailboat having at least two soft sails, including the steps of sensing the wind direction to determine an angle of sail in each of the sails, sensing tensions and/or vibrations in each of the sails to adjust the curvature of that sail, and sensing the wind velocity to take in the sails. The present invention also provides an apparatus of automatically controlling a sailboat having at least two soft sails, including a wind direction sensor, a sail angle adjusting device connected with each of the sails and responsive to the output of the wind direction sensor to adjust an angle of sail in the sail, a sail angle sensor for identifying the adjusted angle of sail, a tension and vibration sensor connected with a sheet of each of the sails, and a curvature adjusting device responsive to the output of the tension and vibration sensor to adjust the curvature of the sail.

5 Claims, 16 Drawing Figures

METHOD AND APPARATUS OF AUTOMATICALLY CONTROLLING SAILBOAT

BACKGROUND OF THE INVENTION

1. Field of the Invention

The present invention relates to a method and apparatus of automatically controlling a sailboat.

2. Description of the Prior Art

Recently, some large-sized ships such as bulk carriers tankers are being provided with sails to save energy. In such large-size ships, a computer is used to control the sails for economical optimization. Sails used in the large-sized ships are substantially made of metals or plastics. Manufacturing cost therefor is huge. Mechanisms for operating the sails are very complicated.

Some fishing boats also begin to use a sailing apparatus having a relatively simplified structure in which when push buttons are manually depressed in the bridge of a fishing boat, sails including jib and main sails can remotely be controlled to hoist or haul down the sails. However, such a sailing apparatus cannot delicately adjust the angle or curvature in the sails depending on the direction and velocity of the wind.

To utilize the wind force with maximum efficiency, the angle and curvature in the sails must be adjusted to generate maximum lift. It is therefore desirable to spread each of the sails on a line bisecting an angle included between the advancing direction of the ship and the apparent wind and also to adjust the curvature of the sail up to a limit to which the sail does not shiver. In the prior art, such controls completely depends on the experiences and feels of a skilled operator. It is also difficult for him to continue the controlling operation throughout the sailing.

The term "angle of sail" used herein means the angle of a sail relative to the fore-and-aft axis of a ship's hull.

The term "angle of boom" used herein means the angle of a boom relative to the fore-and-aft axis of the hull.

The term "apparent wind" used herein means a wind against a ship running on water.

SUMMARY OF THE INVENTION

It is an object of the present invention to a method and apparatus of automatically controlling a sailboat, which can safely and economically control the sails of the sailboat in a relatively simple manner.

Another object of the present invention is to provide a method and apparatus of automatically controlling a sailboat, which can most efficiently utilize the force of wind to provide maximum energy thrusting the sailboat and rapidly accommodate the sailboat to violent changes of the weather on the sea.

Still another object of the present invention is to provide a method and apparatus of automatically controlling a sailboat, which can sensitively select and maintain the most efficient angle and curvature of the sail depending on the direction and velocity of the wind.

The present invention provides a method of automatically controlling a sailboat having at least two soft sails, comprising the steps of sensing the wind direction to determine the angle of sail in said sails, sensing the tension and/or vibration of each of said sails to adjust the curvature of the sail, and sensing the wind velocity to take in said sails.

The present invention also provides an apparatus of automatically controlling a sailboat having at least two soft sails, comprising sensor means for detecting the wind direction, sail angle adjusting means mechanically connected with each of said sails and responsive to the output of said sensor means to adjust the angle of sail in that sail, sail angle sensor means for identifying the adjusted angle of sail, means connected with sheet means of each of said sails to detect the tension and vibration of that sail, and means responsive to the output of said means for detecting the tension and vibration to adjust the curvature of the sail.

DETAILED DESCRIPTION OF PREFERRED EMBODIMENTS

Figure 1:
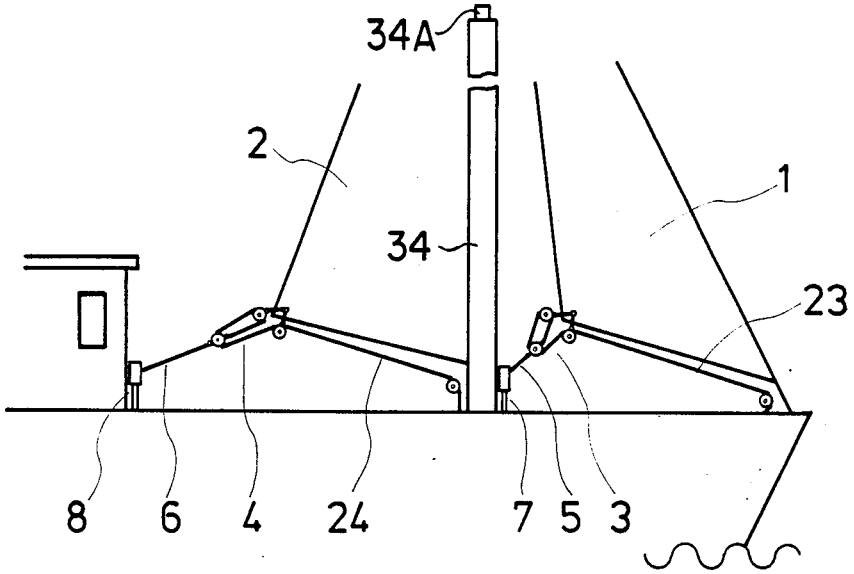
FIG. 1 is a fragmentary side view of a sailboat including an automatic control system according to the present invention.
Figure 2:
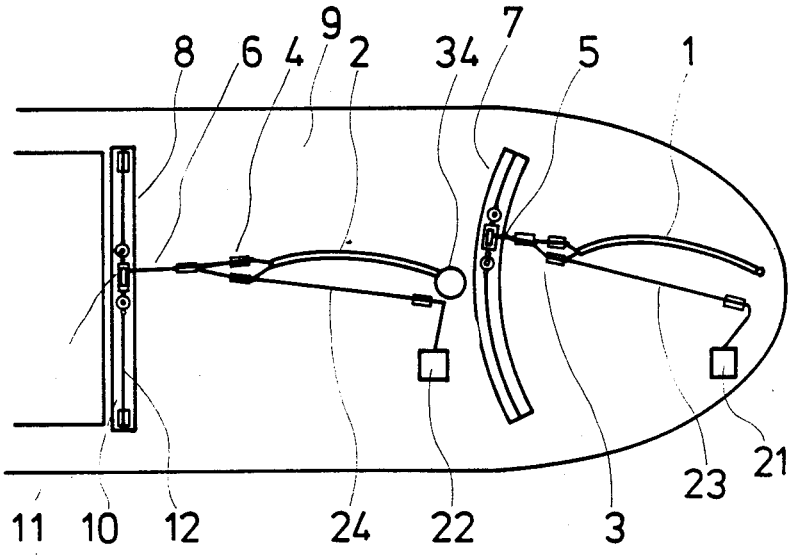
FIG. 2 is a plan view of the sailboat shown in FIG. 1.

Referring now to FIGS. 1 and 2, there is shown the stem of a sailboat having two soft sails, that is, a jib sail 1 and a main sail 2. Each of the sails 1 and 2 is connected with a traveler 7 or 8 by a wire 5 or 6 through a sheet 3 or 4. The traveler 7 is rearwardly arcuate to maintain the length of the sheet 3 in the jib sail 1 constant. On the other hand, the traveler 8 is linear since the length of the sheet 4 in the main sail 2 is variable. The main sail 2 may be provided with a boom as in the conventional main sails. Alternatively, the main sail may be in the form of a staysail as in the conventional ketch rigs.

In accordance with the present invention, moreover, it may be accepted that the traveler 7 for the jib sail 1 is linear while the traveler 8 for the main sail 2 is rearwardly arcuate. Since these travelers 7 and 8 are substantially identical with each other in construction and arrangement, only one of them will be described below.

Figure 5:
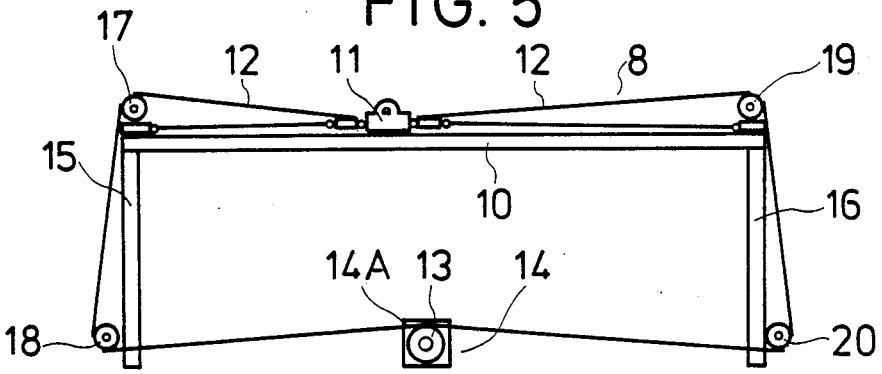
FIG. 5 is a front view of a traveler.
Figure 6:
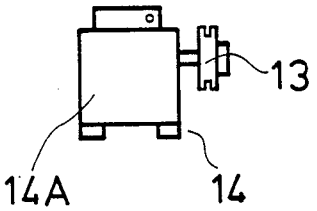
FIG. 6 is a side view of a traveler winch.

As seen best from FIG. 5, the traveler 8 comprises a traveler track 10 extending transversely relative to the fore-and-aft axis of a hull 9 and supported on the hull 9 by means of supports 15 and 16, a traveler lorry 11 movable on the track 10, a length of wire 12 connected with the lorry 11 at the opposite ends thereof, and a traveler winch 14 including a drive pulley around which the wire 12 is wound. The traveler winch 14 also includes a sensor 14A for detecting the direction and speed of its own rotation (see FIG. 6). The end of this sensor 14A will be described.

The wire 12 passes over idler pulleys 17, 18, 19 and 20 which are mounted on the tops and bottoms of the supports 15 and 16, respectively. When the traveler winch 14 is actuated to rotate rightwardly or leftwardly, the traveler lorry 11 is driven to move on the track 10 rightwardly or leftwardly. As a result, the angle of sail will be changed (see FIG. 11).

Figure 3:
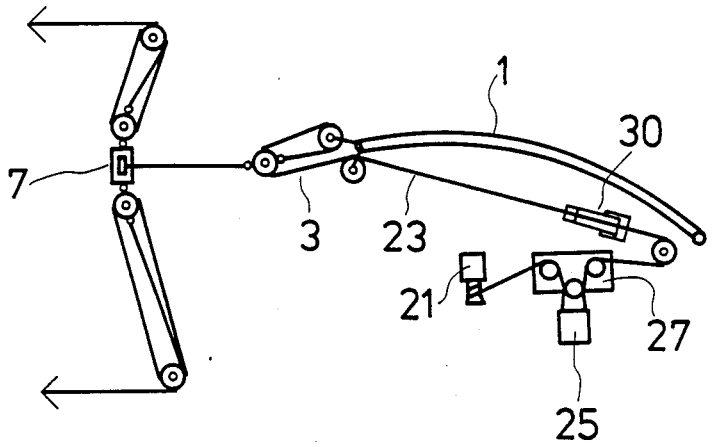
FIG. 3 illustrates an arrangement of various sensors in the automatic control system according to the present invention.
Figure 4:
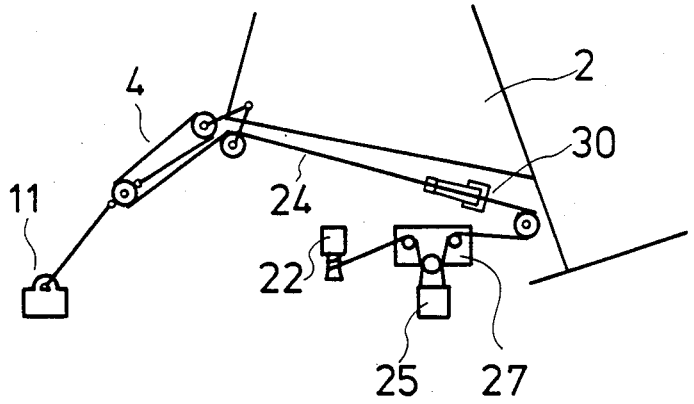
FIG. 4 is a illustrating the construction of a sheet.
Figure 9:
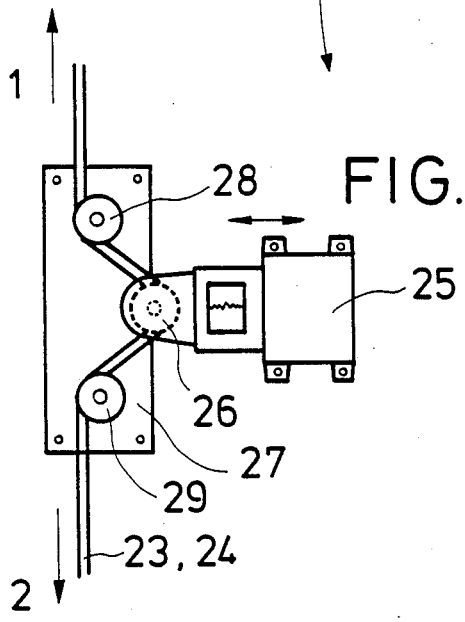
FIG. 9 is a plan view of a tension and vibration sensor.
Figure 10:
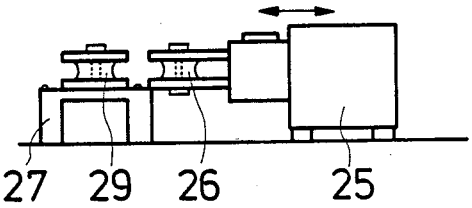
FIG. 10 is a side view of FIG. 9.

As seen best from FIGS. 3 and 4, each of the sheets 3 and 4 which connects the traveler 7 or 8 with the sail 1 or 2 is connected with a sheet winch 21 or 22 through a rigging 23 or 24. Each of the riggings 23 and 24 has its intermediate portion passing through a tension and vibration sensor 25 for detecting the tension and/or vibration in the corresponding sail to actuating the sheet winch 21 or 22 so that the tension of the sail will be adjusted depending on the detected tension and/or vibration. As seen best from FIGS. 9 and 10, the tension and vibration sensor 25 includes a pulley 26 over which the rigging 23 or 24 passes. Each of the riggings 23 and 24 also passes over a pair of pulleys 28 and 29 located on a stationary plate 27 and spaced from each other.

Figure 7:
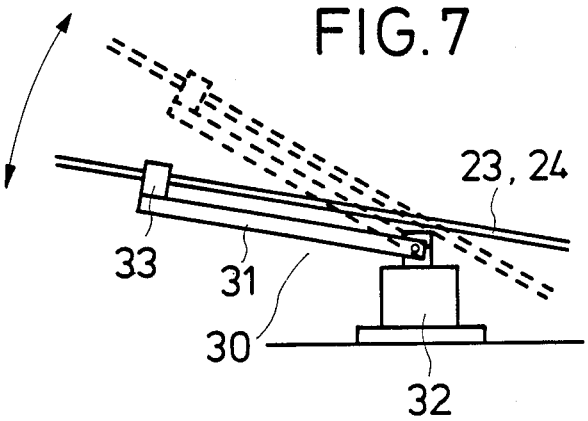
FIG. 7 is a side view of a sail angle sensor.
Figure 8:
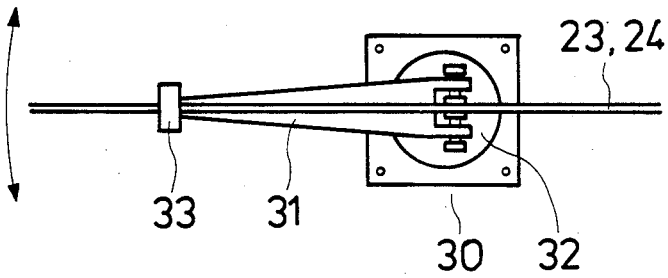
FIG. 8 is a top view of the sensor shown in FIG. 7.

As shown in FIGS. 7 and 8, each of the riggings 23 and 24 also passes through a sail angle sensor 30 which comprises a body 32 and a lever 31 extending slantingly and upwardly from the body 32. The lever 31 has an eye-ring 33 located thereon at the distal end and receiving the corresponding rigging 23 or 24. When the angle of sail is changed to vary the angle of the rigging 23 or 24 relative to the horizontal direction, the lever 31 is pivoted from the present position to another angular position which in turn is detected as a change in the angle of sail by angular variation sensing means (not shown) in the body 32 of the sail angle sensor 30. The angular variation sensing means may be of the conventional type.

In accordance with the present invention, the system further comprises a wind direction and velocity meter 34A on the top of a mast 34. The output of the wind direction and velocity meter is operated by any suitable analyzing circuit with the operated signal being then supplied to the sail angle sensor 30. Then, the travelers 7 and 8 are actuated in accordance with instructions previously inputted thereto to set the angle of sail in each of the jib and main sails 1, 2. The set angle of sail is identified by the sail angle sensor 30. In such a manner, a step determining the angle of sail in each of the jib and main sails 1, 2 will be completed.

Depending on the tension and/or vibration of the jib and main sails 1, 2 thus set, the sheet winches 21 and 22 are correspondingly actuated to tighten or loosen the sails 1 and 2.

The adjusted angle of sail is read and identified by the sail angle sensor 30.

Figure 11:
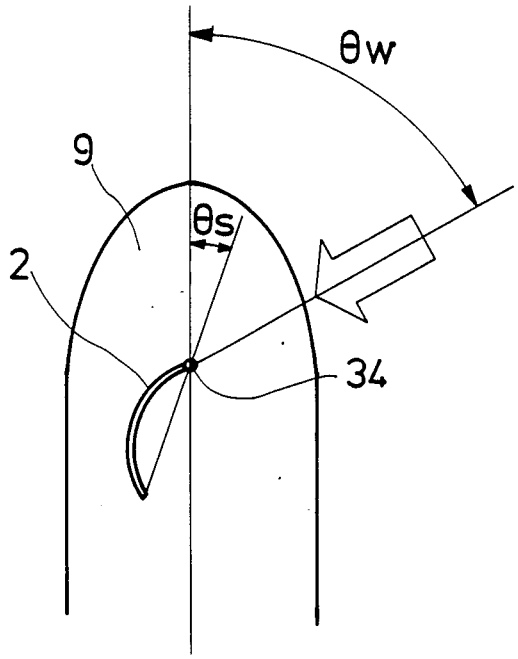
FIG. 11 illustrates the relationship between an angle of sail and the wind direction.

If the angle of sail $\theta s$ is smaller than the angle of wind $\theta w$ as shown in FIG. 11, for example, when the tension of a sail is equal to or less than 10% of its breaking strength, the angle of sail $\theta s$ of the jib sail 1 is set at $\frac{1}{4}w$ while the main sail 2 has its angle of sail $\theta s$ set at $1/6w$. This combination is experimentally determined for the respective tensions in the sails.

Figure 12:
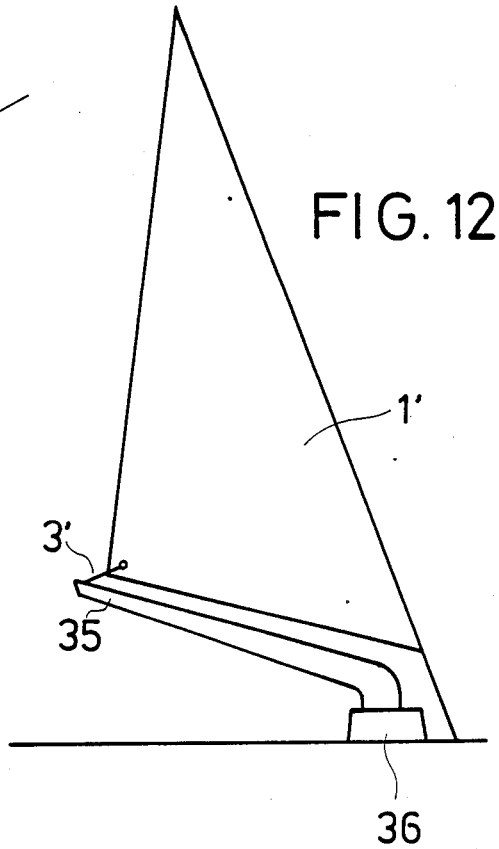
FIG. 12 is a side view of another form of a sail angle adjusting device according to the present invention.

Each of the travelers 7 and 8, which is sail angle adjusting means, may be replaced by a boom 35. As shown in FIG. 12, the sail end of a jib sail 1' is connected with the free end of a boom 35 through a sheet 3'. The opposite end of the boom 35 is rotatably connected with the hull through a boom winch 36.

The boom winch 36 is provided with a boom angle sensor which is not shown and may be of the conventional type. The boom angle sensor functions to detect the angle of the boom 35 relative to the fore-and-aft axis of the hull. Briefly, the construction and function of the boom angle sensor are similar to those of the aforementioned sail angle sensor.

Similarly, a wind direction and velocity meter (not shown) is mounted on the top of a mast. The output of the wind direction and velocity meter causes the boom 35 to actuate so as to determine an angle position in the boom 35. The sheet winch (not shown) for the jib sail 1' is actuated to tighten or loosen the jib sail depending on the tension and/or vibration of the jib sail 1' at that time. The determined angle of the boom is identified by the corresponding one of the boom angle sensors.

Figure 13:
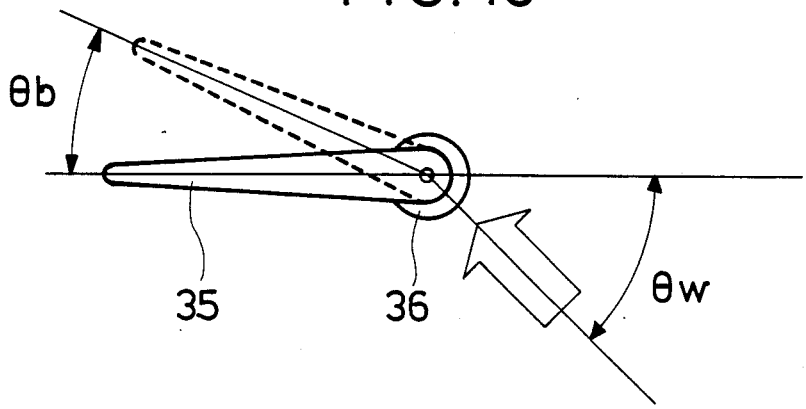
FIG. 13 illustrates the relationship between the angle of a boom and the wind direction.

If the boom angle $\theta b$ is smaller than the angle of wind $\theta w$ as shown in FIG. 13, the following formula is established:

$$\theta b = K \cdot \theta w.$$

The value of K is pre-determined depending on the shape and position of a particular sail. For example, if five sails are disposed spaced from one another along the fore-and-aft axis of a hull, they have the respective values of K; $\frac{1}{2}$, $\frac{1}{3}$, $\frac{1}{4}$, 1/5 and 0 since a rearward sail will be influenced by another forward sail. The boom angle in the last sail may be equal to zero wherein its boom is positioned on the fore-and-aft axis of the hull.

The boom angle may be adjusted by a so-called "follow-up" system which is actuated by instructions from the sail angle sensor or boom angle sensor. Alternatively, it may be adjusted by a system which is quantatively driven in accordance with a preset program.

If the wind velocity exceeds 20 meters/seconds, an alarm is actuated by information from the wind velocity meter and at the same time the sails begin to be taken in. The jib sail may simply be taken in by a known roller furling system which is, for example, "HARKEN" (trade mark). The main sail may be wound about a rotary drum housed in the mast or may be wound around the outer periphery of the mast. As means for doing this, for example, there is known a stowaway sail system commercially available unter the trade mark "HOOD". Power for taking in the sails may be provided by a motor which is energized by the output of a wind velocity sensor in the wind velocity meter. Mechanisms for taking in the sails are generally known by those skilled in the art and will not further be described herein.

Assuming that the full open of a sail corresponds to 100% of its area, the present invention may provide a desirable relationship between wind velocities and degrees of taking in sail as follows:

| Wind Velocity | Sail Area |
|---|---|
| 20 meters/sec. | 80% |
| More than 20 meters/sec. Up to 22 meters/sec. | 60% |
| More than 22 meters/sec. Up to 24 meters/sec. | 40% |
| More than 24 meters/sec. Up to 26 meters/sec. | 20% |

-continued

| Wind Velocity | Sail Area |
|---|---|
| More than 26 meters/sec. | 0% |

If the wind velocity exceeds 26 meters/seconds or if the wind direction is equal to or smaller than 20°, experiments show that it is desirable to completely furl all the sails.

Figure 14:
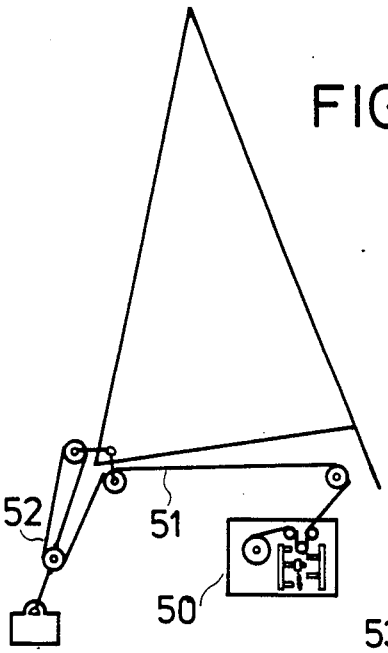
FIG. 14 is a schematic side view of another form of sheeting means in an automatic control apparatus according to the present invention.
Figure 15:
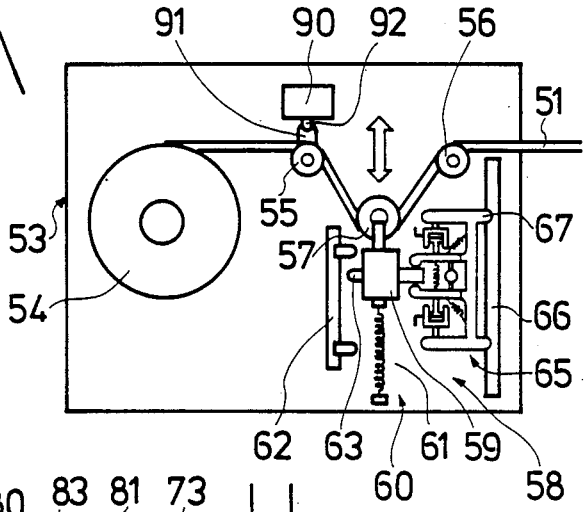
FIG. 15 is a schematic side view, partially broken, of the details of the sheeting means shown in FIG. 14.
Figure 16:
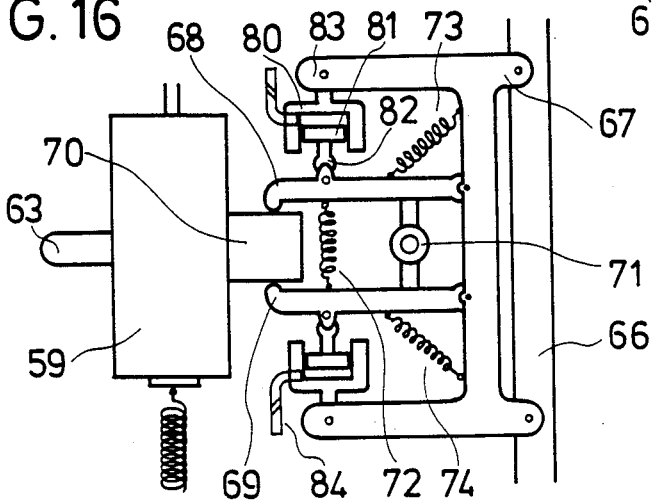
FIG. 16 is a fragmentary view, in an enlarged scale, of the vibration sensor shown in FIG. 15.

Referring next to FIGS. 14 to 16, there is shown another embodiment of the present invention which comprises sheeting means 50 incorporating a tension and vibration sensor and a winch. The sheeting means 50 is connected with a tackle 52 through a sheet 51. The tackle 52 may be connected with a traveler (not shown) as in the previously described embodiment.

The sheeting means 50 includes a casing 53 in which there are housed a hydraulic motor driven reel winch 54 connected with the leading end of the sheet 51, a pair of stationary rollers 55, 56 disposed to receive the sheet 51 and spaced from each other, a movable roller 57 located between the stationary rollers 55 and 56 and engaged by the sheet 51 and a tension and vibration sensor 58 connected with the movable roller 57.

The tension and vibration sensor 58 includes a tension sensor section 60 which includes an actuating member 59 rigidly connected with the movable roller 57. The actuating member 59 is linearly guided and moved on guide rails (not shown) and connected with a tension spring 61 such that the actuating member 59 will be biased to retract the movable roller 57. A hydraulic switch 62, which is a first switch, is disposed along the path of the actuating member 59. The hydraulic switch 62 will be actuated by a pin 63 laterally projecting from the actuating member 59 to energize and de-energize a reel winch 54 as will be described in detail.

The tension and vibration sensor 58 further includes a vibration sensor section 65 which includes a track 66 extending parallel to the path of the actuating member 59. A slider 67 is slidably mounted on the track 66. The slider 67 is of substamntially H-shape on the central connecting portion of which a pair of spaced arms 68 and 69 are pivotally mounted. The outer ends of the arms 68 and 69 sandwiches a projection 70 laterally extending from the actuating member 59 of the tension sensor section 60. To eliminate any noise on operation, the projection 70 is preferably made of any suitable soft material such as rubber.

A hydraulic switch 71, which is a second switch, is connected between the arms 68 and 69 adjacent to their inner ends. The hydraulic switch 71 is actuated when the spacing between the arms 68 and 69 is increased more than a predetermined distance.

A tension spring 72 also is operatively located between the arms 68 and 69 to bias them toward each other. The tension of the spring 72 is balanced by tension springs 73 and 74 which are respectively connected between the respective arms and the slider 67 to bias the arms away from each other.

A delaying cylinder 80 is mounted on each of the arms 68 and 69 adjacent to its outer end with a piston 81 thereof being pivoted to the arm through a rod 82. The delaying cylinder 80 serves to delay the response of that arm against the motion of the actuating member 59 in the tension sensor 60. The opposite end of the cylinder 80 is pivotally connected with the corresponding head 83 of the H-shaped slider 67. Each of the delaying cylinders 80 includes a capillary plug 84 which will be described.

The tension sensor 60 in the sheeting means 50 will be operated as follows:

If the tension in the sheet 51 exceeds a given acceptable level to move the movable roller 57 upwardly as viewed in FIG. 15, the actuating member 59 is moved upwardly through the sheet 51 until the pin 63 on the actuating member 59 is engaged by the OFF contact on the first switch, that is, the hydraulic switch 62. When this occurs, the brake in the hydraulic motor is released to permit the reel winch 54 to freely unwind the sheet 51. As a result, the sail connected with the sheet 51 is loosened. When the amount of the unwound sheet 51 exceeds a predetermined level, the movable roller 57 is moved downwardly as viewed in FIG. 15 under the action of the spring 61 until the pin 63 on the actuating member 59 is engaged by the ON contact on the hydraulic switch 62. As a result, the hydraulic motor in the reel winch 54 is energized to wind the sheet 51 so as to eliminate the loosened sail portion.

In such a manner, the tension in the sheet 51 connected with the sail can always be monitored and adjusted.

The vibration sensor 58 will now be described with respect to its operation. The slider 67 of the vibration sensor 58 always follows the actuating member 59 of the tension sensor 60 since the slider 67 can slidably be moved on the track 66. When vibrations or shivers occur in a sail, they are transmitted to the movable roller 57 through the sheet 51. As a result, the movable roller 57 also is vibrated. Since such vibrations also are transmitted to the actuating member 59, the arms 68 and 69 are then moved away from each other. When the spacing between the arms 68 and 69 exceeds a predetermined level, the second switch or the hydraulic switch 71 is actuated to energize the hydraulic motor in the reel winch 54 and at the same time to release the brake for the drive shaft of the hydraulic motor.

As the vibrations disappear, the spacing between the arms 68 and 69 decreases and then the hydraulic switch 71 is turned off to de-energize the hydraulic motor and brake its rotating shaft.

As well-known in the art, the hydraulic motor in the reel winch 54 is provided with a hydraulic brake and a slow-down brake. The slow-down brake serves to prevent the sheet from being runaway, as in the self-timer of the camera. Therefore, the slow-down brake is actuated only on unwinding of the sheet. The hydraulic brake acts on the drive shaft in the hydraulic motor.

In the present embodiment, a timer 90 is disposed adjacent to one of the stationary rollers 55 and functions to release the brake of the reel winch 54 at time intervals of 30 minutes or one hour. When this occurs, the reel winch 54 unwinds the sheet at a speed which is controlled by the slow-down brake. The stationary roller 55 is provided with a projection 91 which is adapted to engage a switch 92 on the timer 90 on each revolution of the stationary roller 55 to initiate the operation of the timer 90.

Under the action of the timer 90, the sheet 51 is unwound from the reel winch 54 by an amount corresponding to one revolution of the stationary roller 55 at time intervals of 30 minutes or one hour. The sail is the no loosened. If the sail is loosened more than a predetermined amount, the sail will begin to shiver or vibrate. This causes vibrations in the sheet 51 which in turn are sensed by the sheeting means.

As described previously, both the sensors 58, 60 operate substantinally simultaneously under all tensions. However, the hydraulic switch 71 is turned on after a time delay under the influence of the capillary plugs 84 in the delaying cylinders 80. This time delay may be adjusted by replacing the capillary plugs 84 by other capillary plugs having different sizes.

When the hydraulic switch 71 is actuated, the hydraulic motor is energized and at the same time its brake is released to initiate the winding operation of the reel winch. When the sail is tensioned to its tight state, the shivers are stopped. After a time delay, the hydraulic switch 71 is turned off to de-energize the hydraulic motor and simultaneously to actuate its brake. Subsequently, the operation similar to those previously described is repeated to maintain the sail at its state immediately before it begins to shiver.

Although the present invention has been described as to some preferred embodiments, it is not limited to these described and illustrated embodiments and may be changed and modified without departing from the spirit and scope of the invention as defined in the appended claims.

The automatic control apparatus according to the present invention may be combined with an auto-helm or auto-pilot to automatically advance a sailboat in a desired direction. Furthermore, the apparatus may be combined with a satellite navigation system or loran C to automatically advance a sailboat to a goal through the shortest distance.

We claim:

1. An apparatus of automatically controlling a sailboat having at least two soft sails, comprising wind direction sensor means, means connected with each of said sails and responsive to the output of said wind direction sensor means to adjust an angle of sail in the sail, sail angle sensor means for identifying the adjusted angle of sail, tension and vibration sensor means connected with a sheet of each of said sails, and means resposive to the output of said tension and vibration sensor means to adjust the curvature of the sail.

2. An apparatus as defined in claim 1 wherein said sail angle, angle adjusting means comprises a traveler track located on the hull and extending transversely of said hull, a traveler lorry movable on said traveler track, a drive wire connected at the opposite ends with said traveler lorry, and a traveler winch for moving said drive wire, said traveler winch including means for sensing the rotation and speed of said traveler winch.

3. An apparatus as defined in claim 1 wherein said curvature adjusting means comprises a movable pulley over which the sheet connected with the sail passes, an actuating member rigidly connected with said movable pulley, a first switch connected with a winch for winding and unwinding said sheet and adapted to be turned on or off by said actuating member depending on its position to energize or de-energize said winch, and a second switch operatively connected with said actuating member and actuated to energize said winch so as to initiate the winding of said sheet when the movement of said actuating member exceeds a predetermined level.

4. An apparatus as defined in claim 3 wherein said second switch includes means for delaying its response.

5. An apparatus as defined in claim 3 wherein said delaying means is adjustable.

* * * * *